US011776477B1

(12) United States Patent
Hsiao

(10) Patent No.: US 11,776,477 B1
(45) Date of Patent: Oct. 3, 2023

(54) PIXEL CIRCUIT OF A DISPLAY PANEL

(71) Applicant: NOVATEK MICROELECTRONICS CORP., Hsinchu (TW)

(72) Inventor: Sheng-Wen Hsiao, Shetou Township (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 18/147,112

(22) Filed: Dec. 28, 2022

(51) Int. Cl.
*G09G 3/3233* (2016.01)

(52) U.S. Cl.
CPC ... *G09G 3/3233* (2013.01); *G09G 2300/0823* (2013.01)

(58) Field of Classification Search
CPC ..... G09G 3/3233
USPC ..... 345/204
See application file for complete search history.

(56) References Cited

U.S. PATENT DOCUMENTS 9,384,700 B2 * 7/2016 Chen ..... G09G 3/3291
2007/0205970 A1 * 9/2007 Tang ..... G09G 3/3655 345/87
2016/0171947 A1 * 6/2016 Chen ..... G09G 3/3659 345/88

* cited by examiner

*Primary Examiner* — Calvin C Ma
(74) *Attorney, Agent, or Firm* — Rosenberg, Klein & Lee

(57) ABSTRACT

A pixel circuit of a display panel is provided, including a first, second, third, fourth, fifth switch, a first capacitor and a diode. The first switch is connected with a positive supplied power voltage. The second switch is connected with the first switch and a data line. The third switch is connected with the first and second switch, generating an emission current as a driving transistor. First end of the first capacitor is connected with the first, second and third switch. Second end of the first capacitor is connected with the third, fourth and fifth switch. The fifth switch is connected with a first initial voltage. Anode of the diode is connected with the third and fourth switch while its cathode is connected with a negative emission source voltage. By configuration of the disclosed pixel circuit, a power rail emission current is independent, without being involved with initial voltages.

14 Claims, 18 Drawing Sheets

PIXEL CIRCUIT OF A DISPLAY PANEL

BACKGROUND OF THE INVENTION

Field of the Invention

The present invention is related to a pixel circuit of a display panel. More particularly, it is related to a pixel circuit applicable to driving a display panel, in which its emission current is independent and has no relations with any initial voltage being applied to a power rail of the display panel.

Description of the Prior Art

As known, one common application of the RGB color model is the display of colors on a cathode-ray tube (CRT), liquid-crystal display (LCD), plasma display, or organic light emitting diode (OLED) display such as a television, a computer's monitor, or a large-scale screen. Each pixel on the screen is built by driving three small and very close but still separated RGB light sources. At common viewing distance, the separate sources are indistinguishable, which tricks the eye to see a given solid color. All the pixels together arranged in the rectangular screen surface conforms the color image.

During digital image processing, each pixel can be represented in the computer memory or interface hardware (for example, a graphics card) as binary values for the red, green, and blue color components. When properly managed, these values are converted into intensities or voltages via gamma correction to correct the inherent nonlinearity of some devices, such that the intended intensities are reproduced on the display. Usually, at least one active matrix is used and designed to update display row data row by row, such that when the current gate line is active, new row data can be updated to an active pixel driver's storage capacitor for performing imaging. In a traditional design scheme, the cell pixel driver or active matrix may be fabricated in a Metal-Oxide-Semiconductor (MOS) transistor process or in a thin-film transistor (TFT) transistor process.

In general, as one conventional silicon-based μOLED driver circuit in the prior art has been known, the conventional silicon-based μOLED driver circuit usually comprises a plurality of element components, including transistors as well as capacitors. The capacitors are usually considered as storage capacitors for holding an emission current of a main transistor in the driver circuit. And a conducting diode in the μOLED driver circuit is illustrated as an OLED. As known, the main transistor in the driver circuit performs as a main driving transistor of the circuit diagram. According to the prior art, in order to overcome the VTH deviation of the main transistor, capacitor strap techniques are usually implemented. As known, different storage capacitor voltage will make the emission current of the main transistor distinct. And thus, by generating the different current flowing through the diode OLED, it controls the OLED to emit with a variety of luminous brightness. In this way, gray level of single color can be performed. However, what draws our attention is that, since the main transistor in the driver circuit is mainly fabricated in view of a MOSFET process, its current is mostly likely to be affected by the conventional body effect due to its transistor feature. In addition, process variations of the storage capacitors also have a great impact on the emission current of the main transistor in the driver circuit. Therefore, in the prior art, it is apparently necessary to design and fabricate the storage capacitors precisely and in a sophisticated manner. As such, circuit layout complexity and difficulty remain still high and challenging in the prior art so far.

As a result, it, in view of all, should be apparent and obvious that there is indeed an urgent need for the professionals in the field for a novel and inventive pixel circuit diagram to be developed for the current display panel, so as to solve the above-mentioned issues, and to obtain an optimized emission current of a display panel.

SUMMARY OF THE INVENTION

In order to overcome the above-mentioned disadvantages, one major objective in accordance with the present invention is to provide a novel pixel circuit of a display panel.

The proposed pixel circuit is applicable to a display panel which is composed of, for instance, a plurality of Micro Light-Emitting Diodes (μLED), Organic Light-Emitting Diodes (OLED), silicon-based diodes, or the like. The present invention is not limited thereto any variation or modification in consideration with the types of the diodes. In other words, for those who are skilled in the art, it can be feasible to make equivalent modifications and variations based on their actual product specifications. And yet, it is believed that such modified embodiments should still fall within the scope of the present invention.

In specific, according to one embodiment of the invention, the disclosed pixel circuit of a display panel comprises a first switch, a second switch, a third switch, a first capacitor, a fourth switch, a fifth switch and a diode. The first switch is electrically connected with a positive supplied power voltage. The second switch is electrically connected with the first switch and a data line. The third switch is electrically connected with a common terminal of the first switch and the second switch, and the third switch is operable to generate an emission current as a driving transistor of the pixel circuit. The first capacitor includes a first end and a second end, wherein the first end of the first capacitor is electrically connected with a common terminal of the first switch, the second switch and the third switch. The fourth switch is electrically connected with the second end of the first capacitor and the third switch. The fifth switch is electrically connected with a first initial voltage, and the second end of the first capacitor is further electrically connected with a common terminal of the third switch, the fourth switch and the fifth switch. The diode includes an anode connected with a common terminal of the third switch and the fourth switch, and a cathode connected with a negative emission source voltage.

According to the embodiment of the invention, the above-mentioned first switch, the second switch, the third switch, the fourth switch and the fifth switch can be implemented by employing a P-type Metal-Oxide-Semiconductor Field-Effect Transistor (P-MOSFET).

As a result, according to the embodiment, when the first switch, the third switch and the diode are turned off while the second switch, the fourth switch and the fifth switch are turned on, the first capacitor is initialized. Subsequently, when the first switch, the fifth switch and the diode are turned off while the second switch, the third switch and the fourth switch are turned on, the first capacitor is sampled and compensated for data to write in. And at last, when the first switch, the third switch and the diode are turned on while the second switch, the fourth switch and the fifth switch are turned off, a power rail emission current is generated and only related to the positive supplied power voltage and a data voltage of the data line. Therefore, the present invention achieves to control the power rail emission current to be generated independently, and not related to any initial voltages.

In addition, according to a variant embodiment of the present invention, the proposed pixel circuit may further comprise a sixth switch, which is being electrically connected between a drain of the foregoing third switch, a drain of the foregoing fourth switch and the anode of the diode. To be specific, the sixth switch, may also be a P-type MOSFET, such that a source of the sixth switch is electrically connected with the drain of the third switch and the drain of the fourth switch, a gate of the sixth switch is electrically connected with a gate of the first switch, and a drain of the sixth switch is electrically connected with the anode of the diode. By further disposing the sixth switch in the pixel circuit diagram, it allows a much more flexible voltage value given in the pixel circuit, for instance, the first initial voltage and a data voltage of the data line. Therefore, the present invention is characterized by having superior design flexibility.

Moreover, according to another variant embodiment of the present invention, the proposed pixel circuit may further comprise a second capacitor, wherein the second capacitor includes a first end and a second end. In such an embodiment, the first end of the second capacitor is electrically connected with a reference voltage, and the second end of the second capacitor is electrically connected to the second end of the first capacitor, a gate of the third switch, a source of the fourth switch and a source of the fifth switch. As a result, by such configuration, the present invention achieves to control the power rail emission current to be generated independently, and not related to any initial voltages. In addition, by further disposing the second capacitor in the pixel circuit diagram, it is aimed to increase and raise the power rail emission current significantly.

And yet, according to one another variant modified embodiment of the present invention, the disclosed pixel circuit of a display panel, may alternatively comprise both the above-mentioned sixth switch and the second capacitor in the circuit diagram at the same time. According to such an embodiment, then the disclosed pixel circuit achieves in both increasing the design flexibility as well as increasing the power rail emission current to be generated in the circuit diagram.

To sum up, it is thereby, believed that the present invention achieves to successfully solve the problems of prior arts and performs as being highly competitive and able to be widely utilized in any related industries.

These and other objectives of the present invention will become obvious to those of ordinary skill in the art after reading the following detailed description of preferred embodiments.

It is to be understood that both the foregoing general description and the following detailed description are exemplary and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
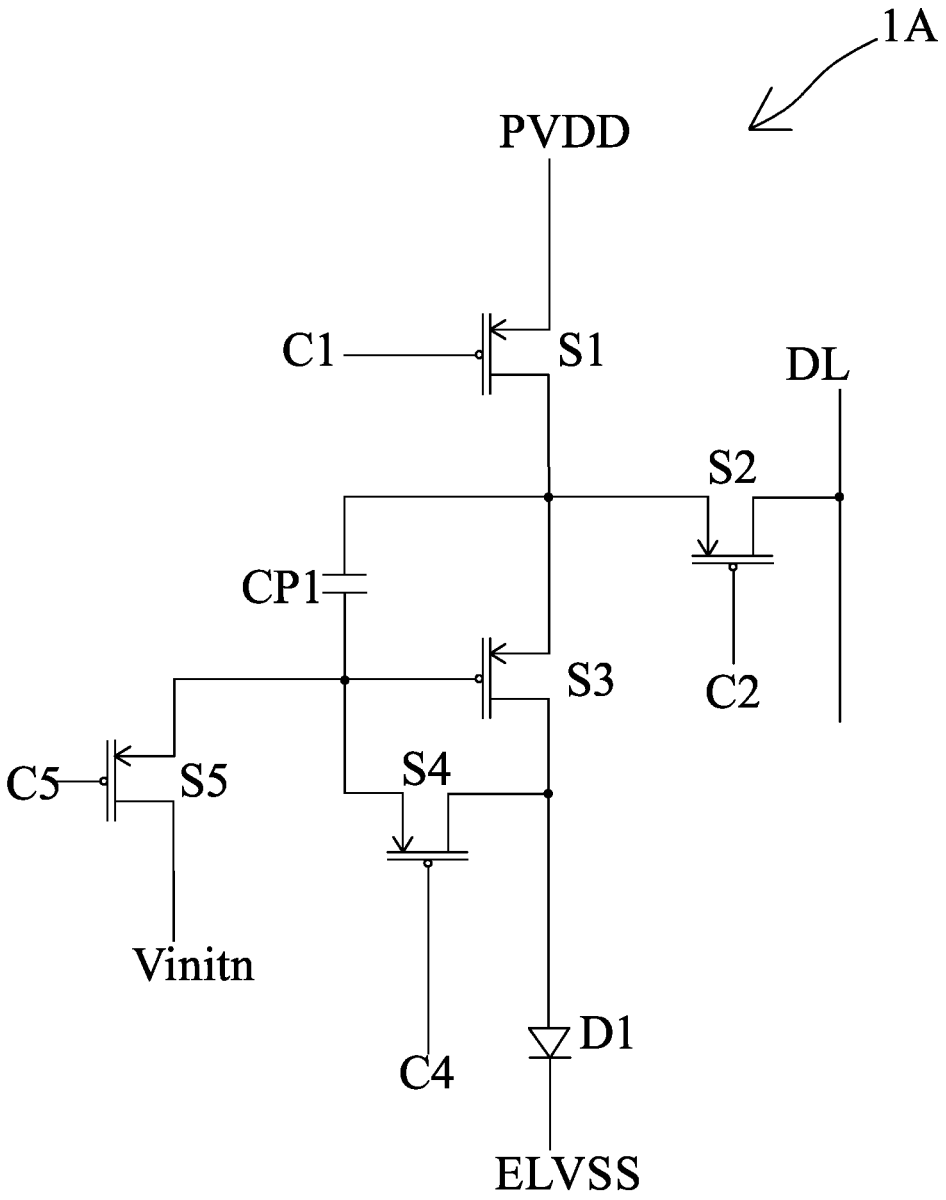
FIG. 1 shows a diagram schematically illustrating a pixel circuit of a display panel in accordance with a first embodiment of the present invention.

Reference will now be made in detail to embodiments illustrated in the accompanying drawings. Wherever possible, the same reference numbers are used in the drawings and the description to refer to the same or like parts. In the drawings, the shape and thickness may be exaggerated for clarity and convenience. This description will be directed in particular to elements forming part of, or cooperating more directly with, methods and apparatus in accordance with the present disclosure. It is to be understood that elements not specifically shown or described may take various forms well known to those skilled in the art. Many alternatives and modifications will be apparent to those skilled in the art, once informed by the present disclosure.

Unless otherwise specified, some conditional sentences or words, such as "can", "could", "might", or "may", usually attempt to express that the embodiment in the invention has, but it can also be interpreted as a feature, element, or step that may not be needed. In other embodiments, these features, elements, or steps may not be required.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The phrases "be coupled to," "couples to," and "coupling to" are intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

The invention is particularly described with the following examples which are only for instance. Those skilled in the art will readily observe that numerous modifications and alterations of the device and method may be made while retaining the teachings of the invention. Accordingly, the following disclosure should be construed as limited only by the metes and bounds of the appended claims. In the whole patent application and the claims, except for clearly described content, the meaning of the article "a" and "the" includes the meaning of "one or at least one" of the element or component. Moreover, in the whole patent application and the claims, except that the plurality can be excluded obviously according to the context, the singular articles also contain the description for the plurality of elements or components. In the entire specification and claims, unless the contents clearly specify the meaning of some terms, the meaning of the article "wherein" includes the meaning of the articles "wherein" and "whereon". The meanings of every term used in the present claims and specification refer to a usual meaning known to one skilled in the art unless the meaning is additionally annotated. Some terms used to describe the invention will be discussed to guide practitioners about the invention. Every example in the present specification cannot limit the claimed scope of the invention.

In the following descriptions, a pixel circuit of a display panel will be provided. According to one embodiment of the present invention, the proposed pixel circuit is applicable to driving a display panel which is composed of Micro Light-Emitting Diodes (μLEDs) or Organic Light-Emitting Diode (OLEDs). However, the present invention is certainly not limited thereto. According to alternative embodiment of the present invention, the display panel whereby the present invention is applied to, may also be composed of other diodes, such as silicon-based diodes. Among all, by adopting the disclosed pixel circuit of the present invention, it is believed that a final emission current of the diode (μLED, OLED, or alternative silicon-based diode) can be independent and has no relations with any initial voltage being supplied to a power rail of the display panel. Therefore, compared to the conventional circuit diagram, the present invention is beneficial to obtaining an optimal emission current and avoiding redundant interferences made to the emission current of the diode in the display panel.

Please refer to FIG. 1, which shows a diagram schematically illustrating a pixel circuit of a display panel in accordance with a first embodiment of the present invention. According to the first embodiment of the present invention, the disclosed pixel circuit 1A includes a first switch S1, a second switch S2, a third switch S3, a fourth switch S4, a fifth switch S5, a first capacitor CP1, and a diode D1. As can be seen in the figure, the first switch S1 is electrically connected with a positive supplied power voltage PVDD. The second switch S2 is electrically connected with the first switch S1 and a data line DL. The third switch S3 is electrically connected with a common terminal of the first switch S1 and the second switch S2, and the third switch S3 is operable to generate an emission current as a driving transistor of the pixel circuit 1A. The diode D1 includes an anode and a cathode, wherein the anode of the diode D1 is electrically connected with a common terminal of the third switch S3 and the fourth switch S4, and the cathode of the diode D1 is electrically connected with a negative emission source voltage ELVSS. According to the embodiment of the present invention, the first switch S1, the third switch S3 and the diode D1 form an emission power rail configured in cascade in the pixel circuit 1A.

In addition, the first capacitor CP1 includes a first end and a second end, wherein the first end of the first capacitor CP1 is electrically connected with a common terminal of the first switch S1, the second switch S2 and the third switch S3. The second end of the first capacitor CP1 is electrically connected with a common terminal of the third switch S3, the fourth switch S4 and the fifth switch S5.

The fourth switch S4 is electrically connected between the second end of the first capacitor CP1 and a common terminal of the third switch S3 and the anode of the diode D1. The fifth switch S5 is electrically connected with a first initial voltage Vinitn, and also electrically connected with the second end of the first capacitor CP1, and a common terminal of the third switch S3 and the fourth switch S4.

According to the embodiment of the present invention, the first switch S1, the second switch S2, the third switch S3, the fourth switch S4, and the fifth switch S5 can be implemented by using a P-type Metal-Oxide-Semiconductor Field-Effect Transistor (P-MOSFET). As such, as can be seen in the figure, a source of the first switch S1 is electrically connected with the positive supplied power voltage PVDD, a gate of the first switch S1 is electrically connected with a first control signal C1, and a drain of the first switch S1 is electrically connected with the first end of the first capacitor CP1, a source of the second switch S2 and a source of the third switch S3.

A source of the second switch S2 is electrically connected with a drain of the first switch S1, a source of the third switch S3 and the first end of the first capacitor CP1. A gate of the second switch S2 is electrically connected with a second control signal C2, and a drain of the second switch S2 is electrically connected with the data line DL.

A source of the third switch S3 is electrically connected with a drain of the first switch S1, a source of the second switch S2 and the first end of the first capacitor CP1. A gate of the third switch S3 is electrically connected with the second end of the first capacitor CP1, a source of the fourth switch S4, and a source of the fifth switch S5. A drain of the third switch is electrically connected with a drain of the fourth switch S4 and the anode of the diode D1.

A source of the fourth switch S4 is electrically connected with the second end of the first capacitor CP1, a gate of the third switch S3 and a source of the fifth switch S5. Moreover, a gate of the fourth switch S4 is electrically connected with a fourth control signal C4, and a drain of the fourth switch S4 is electrically connected with a drain of the third switch S3 and the anode of the diode D1.

As for the fifth switch S5, a source of the fifth switch S5 is electrically connected with the second end of the first capacitor CP1, a gate of the third switch S3 and a source of the fourth switch S4. A gate of the fifth switch S5 is electrically connected with a fifth control signal C5, and a drain of the fifth switch S5 is electrically connected with the first initial voltage Vinitn.

Figure 2:
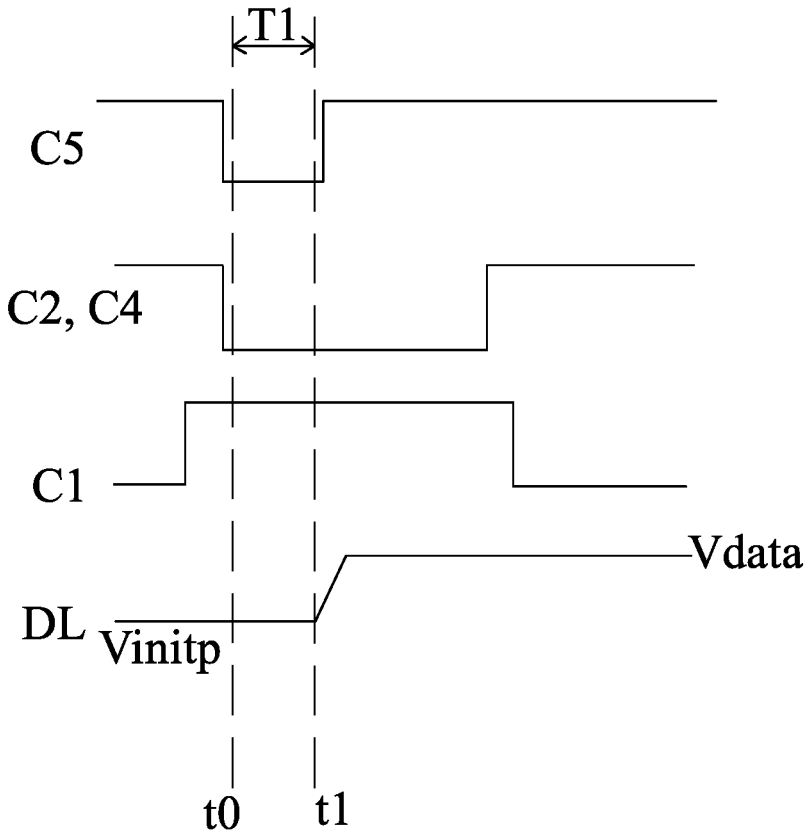
FIG. 2 schematically shows a plurality of waveform diagrams indicating the control signals in view of the voltage level of the data line in a first stage T1 relatively used to control the switches in accordance with the first embodiment of the invention.

Subsequently, for an illustrative embodiment to clearly describe the technical contents of the invention, please refer to FIG. 2, which schematically shows a plurality of waveform diagrams indicating the control signals in view of the voltage level of the data line relatively used to control the switches in accordance with the first embodiment of the invention. As can be seen in FIG. 2, the fifth control signal C5 is transmitted to the gate of the fifth switch S5 as its gate control signal for controlling an on and off state of the fifth switch S5. The second control signal C2 is transmitted to the gate of the second switch S2 as its gate control signal for controlling an on and off state of the second switch S2. In the first embodiment, the fourth control signal C4 is identical to the second control signal C2, and the fourth control signal C4 is transmitted to the gate of the fourth switch S4 as its gate control signal for controlling an on and off state of the fourth switch S4. The first control signal C1 is transmitted to the gate of the first switch S1 as its gate control signal for controlling an on and off state of the first switch S1. A voltage level of the data line DL is initially given at a second initial voltage Vinitp, and raised to a data voltage Vdata afterwards.

Figure 3:
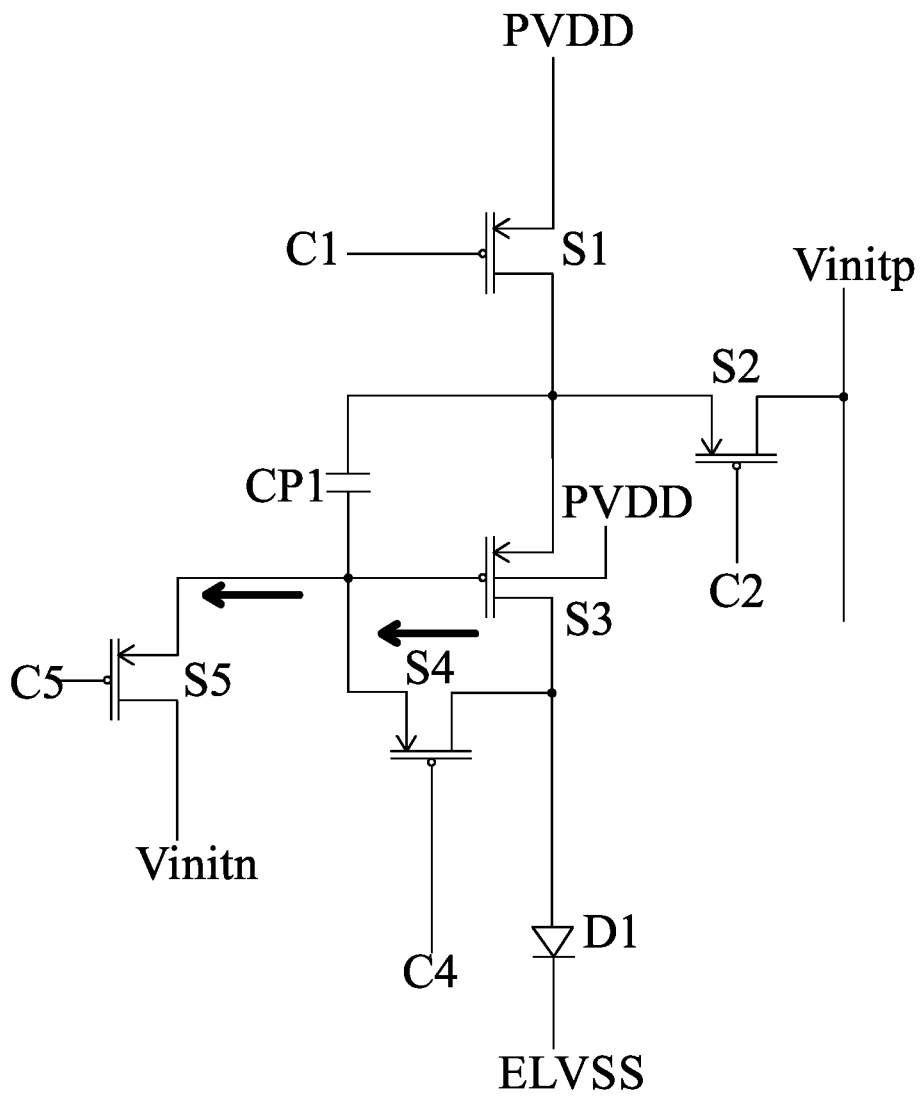
FIG. 3 schematically shows the current flow during the first stage T1 according to FIG. 2.

To be specific, as can be seen in FIG. 2, when the pixel circuit 1A in FIG. 1 is operating in a first stage T1, indicating that $t0<t<t1$, at this period of time, the fifth control signal C5, the second control signal C2 and the fourth control signal C4 are at a low voltage level while the first control signal C1 is at a high voltage level. As a result, the second switch S2, the fourth switch S4 and the fifth switch S5 will be turned on while the first switch S1 is turned off. Meanwhile, since ($Vinitp-Vinitn<Vt_init$), wherein Vt_init is a threshold voltage of the third switch S3, the third switch is turned off as well. In addition, ($Vinitn<ELVSS-Vf_diode$), wherein Vf_diode is a forward voltage of the diode D1, therefore, it is believed that the diode D1 is at an off-state as well. As a result, during the first stage T1 ($t0<t<t1$), it is obtained that the first switch S1, the third switch S3 and the diode D1 are turned off while the second switch S2, the fourth switch S4 and the fifth switch S5 are turned on. The current flow during the first stage T1 ($t0<t<t1$) is illustrated by arrows in FIG. 3. At this period of time, the first capacitor CP1 is thus initialized.

Figure 4:
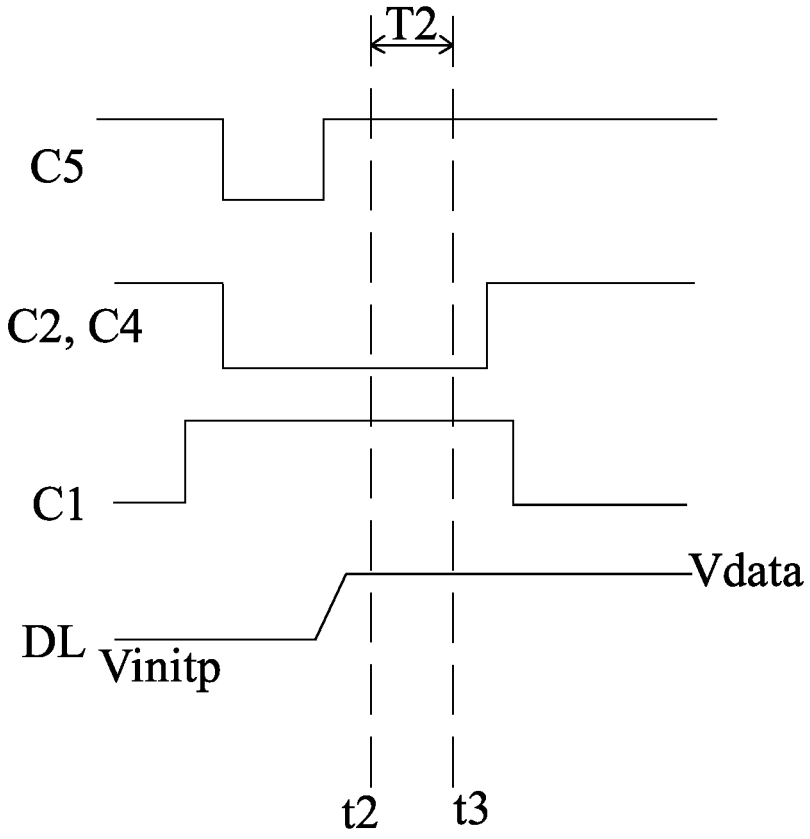
FIG. 4 schematically shows a plurality of waveform diagrams indicating the control signals in view of the voltage level of the data line in a second stage T2 relatively used to control the switches in accordance with the first embodiment of the invention.
Figure 5:
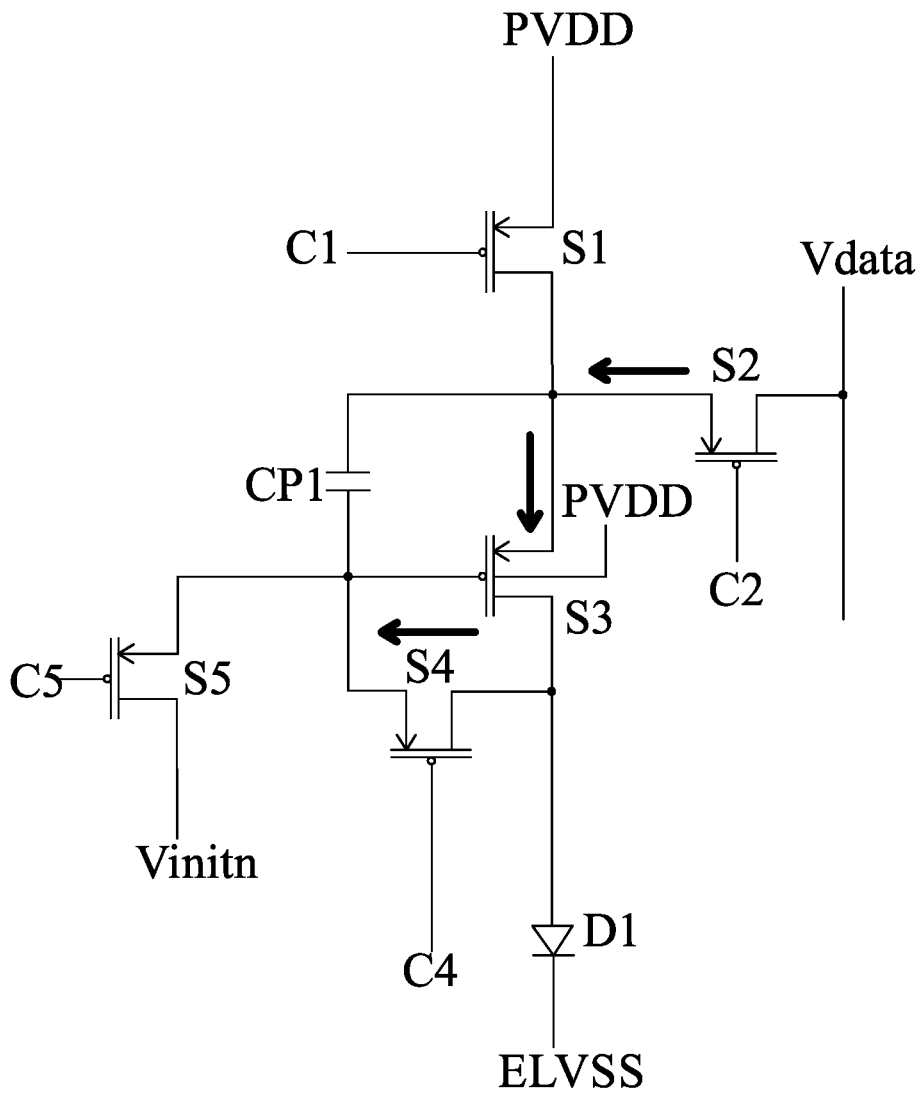
FIG. 5 schematically shows the current flow during the second stage T2 according to FIG. 4.

Later on, please refer to FIG. 4 for a second stage T2, indicating that $t2<t<t3$, at this period of time, the fifth control signal C5 and the first control signal C1 are at a high voltage level while the second control signal C2 and the fourth control signal C4 are at a low voltage level. As a result, the second switch S2, the fourth switch S4 will be turned on while the first switch S1 and the fifth switch S5 will be turned off Meanwhile, since the voltage level of the data line DL is transitioned from the previous second initial voltage Vinitp and raised to the data voltage Vdata at the second stage T2, and ($Vdata-Vt_wr<ELVSS+Vf_diode$), wherein Vt_wr is the compensation/write data state threshold voltage of the third switch S3, it is believed that the diode D1 is at an off-state as well. Therefore, the current flow during the second stage T2 ($t2<t<t3$) is illustrated by arrows in FIG. 5. At this period of time, the first capacitor CP1 is therefore, sampled and compensated for data to write in.

Figure 6:
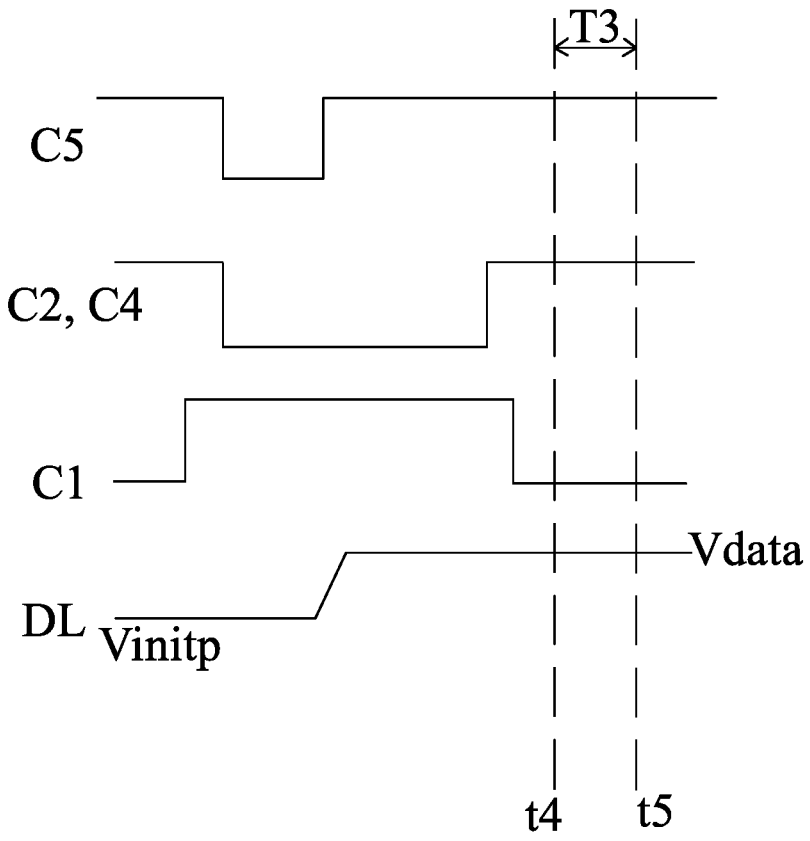
FIG. 6 schematically shows a plurality of waveform diagrams indicating the control signals in view of the voltage level of the data line in a third stage T3 relatively used to control the switches in accordance with the first embodiment of the invention.
Figure 7:
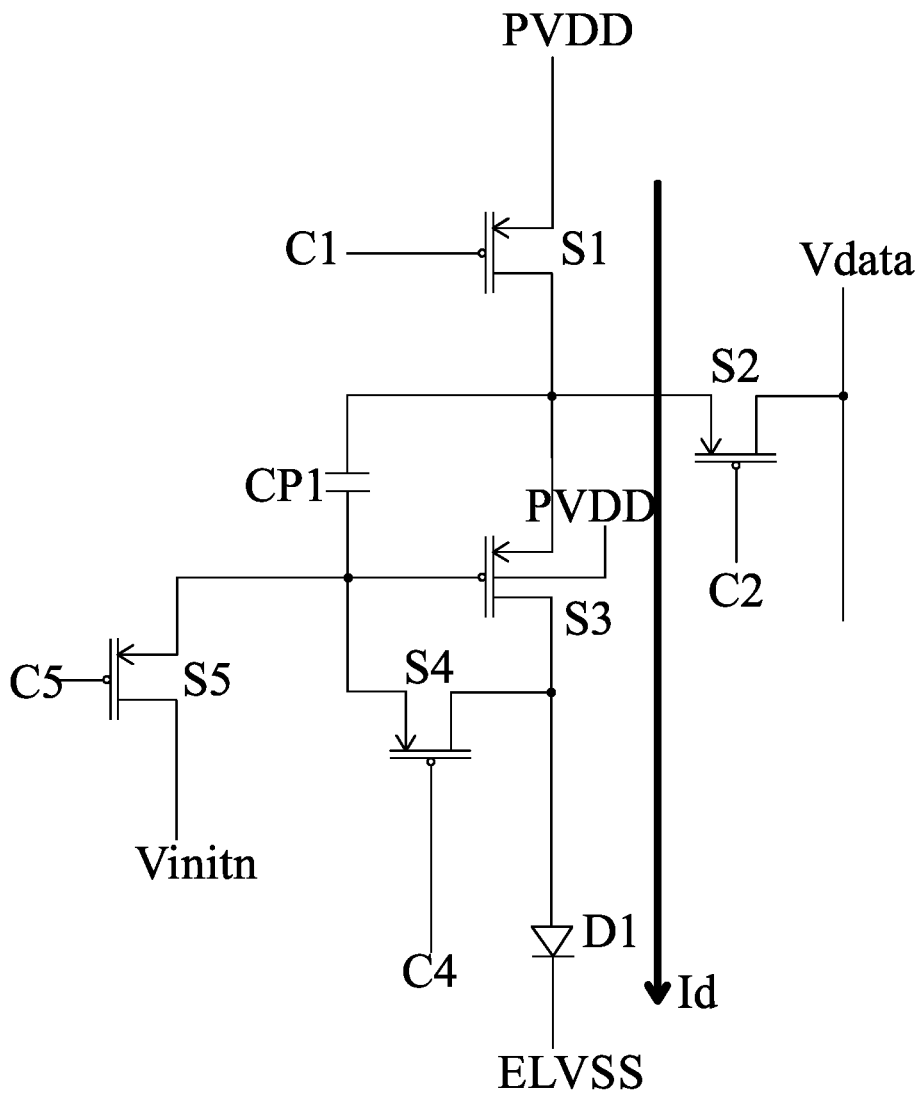
FIG. 7 schematically shows the current flow during the third stage T3 according to FIG. 6.

And finally, as can be seen in FIG. 6, when the pixel circuit 1A in FIG. 1 enters and is operating in a third stage T3, indicating that $t4<t<t5$, at this period of time, the fifth control signal C5, the second control signal C2 and the fourth control signal C4 are at a high voltage level while the first control signal C1 is at a low voltage level. As a result, the second switch S2, the fourth switch S4 and the fifth switch S5 will be turned off while the first switch S1 is turned on. At this period of time during the third stage T3, the third switch S3 and the diode D1 are at an on-state as well. As a result, when the first switch S1, the third switch S3 and the diode D1 are turned on while the second switch S2, the fourth switch S4 and the fifth switch S5 are turned off, it is believed that a power rail composed of the first switch S1, the third switch S3 and the diode D1 is formed, and a power rail emission current is generated. The current flow during the third stage T3 ($t4<t<t5$) is illustrated by arrows in FIG. 7. According to such an embodiment, it is derived that the power rail emission current Id will be a function of ($PVDD-Vdata$). In other words, the final emission current is only related to the positive supplied power voltage PVDD as well as the data voltage Vdata on the data line DL. It has no relations with any initial voltage and will not affected by the process manners and/or process variations of the first capacitor CP1. An optimized result of the power rail emission current Id is therefore, achieved by employing the disclosed pixel circuit of the present invention.

Figure 8:
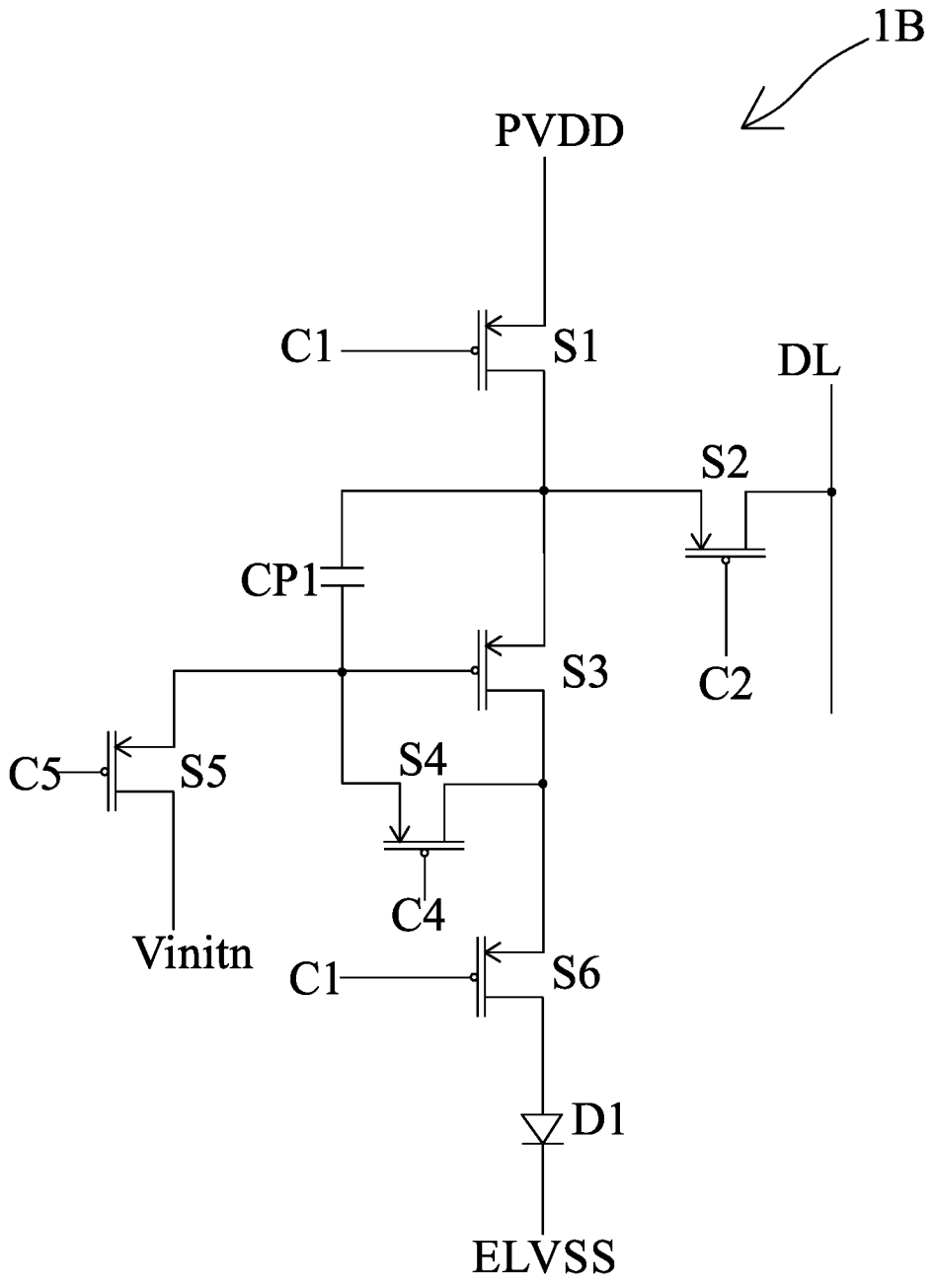
FIG. 8 shows a diagram schematically illustrating a pixel circuit of a display panel in accordance with a second embodiment of the present invention.
Figure 9:
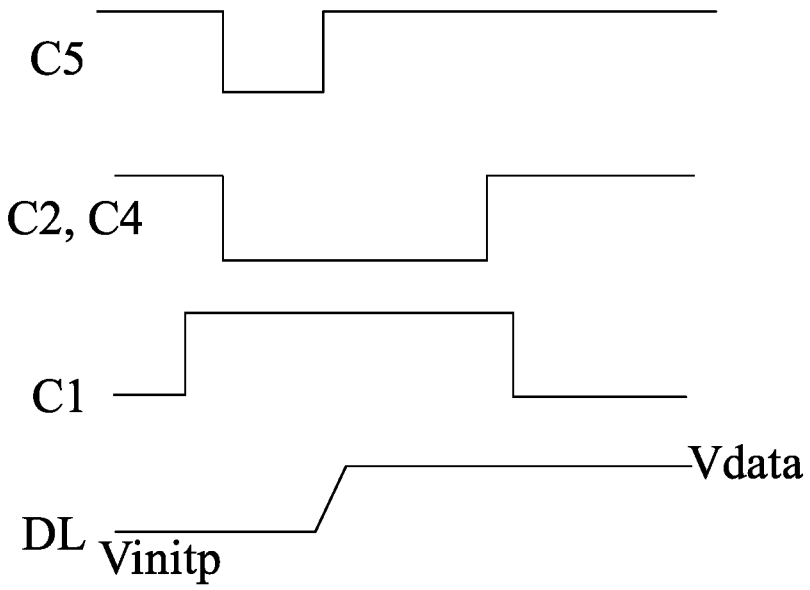
FIG. 9 schematically shows a plurality of waveform diagrams indicating the control signals in view of the voltage level of the data line relatively used to control the switches in accordance with the second embodiment of the invention.

Apart from the above-mentioned embodiment, please proceed to refer to FIG. 8 for a further variant embodiment of the present invention. In FIG. 8, it schematically shows a diagram illustrating a pixel circuit of a display panel in accordance with a second embodiment of the present invention. According to the second embodiment of the present invention, the disclosed pixel circuit 1B includes a first switch S1, a second switch S2, a third switch S3, a fourth switch S4, a fifth switch S5, a first capacitor CP1, a diode D1 and a sixth switch S6. As can be seen in the second embodiment, the pixel circuit 1B, as compared to the previous pixel circuit 1A in the first embodiment in FIG. 1, further comprises a sixth switch S6 being electrically connected between the third switch S3, the fourth switch S4 and the diode D1. According to the second embodiment of the present invention, the sixth switch S6 can be implemented by using a P-type Metal-Oxide-Semiconductor Field-Effect Transistor (P-MOSFET). It is apparent that a source of the sixth switch S6 is electrically connected with a drain of the third switch S3 and a drain of the fourth switch S4. A drain of the sixth switch S6 is electrically connected with the anode of the diode D1. In addition, a gate of the sixth switch S6 will be electrically connected with a gate of the first switch S1. In other words, the control signal transmitted to the gate of the sixth switch S6 for controlling the sixth switch S6, will be identical to the first control signal C1 for controlling the first switch S1. The plurality of waveform diagrams indicating the control signals in view of the voltage level of the data line relatively used to control the switches in accordance with the second embodiment of the invention are provided as shown in FIG. 9. According to the second embodiment, when an additional sixth switch S6 is disposed in the pixel circuit 1B and connected to the anode of the diode D1, it enhances to increase design flexibility of the voltage value of the given first initial voltage Vinitn, the second initial voltage Vinitp, and the data voltage Vdata. As a result, a much more flexible design voltage can be predetermined and performs as an inventive effect of the second embodiment of the present invention.

Figure 10:
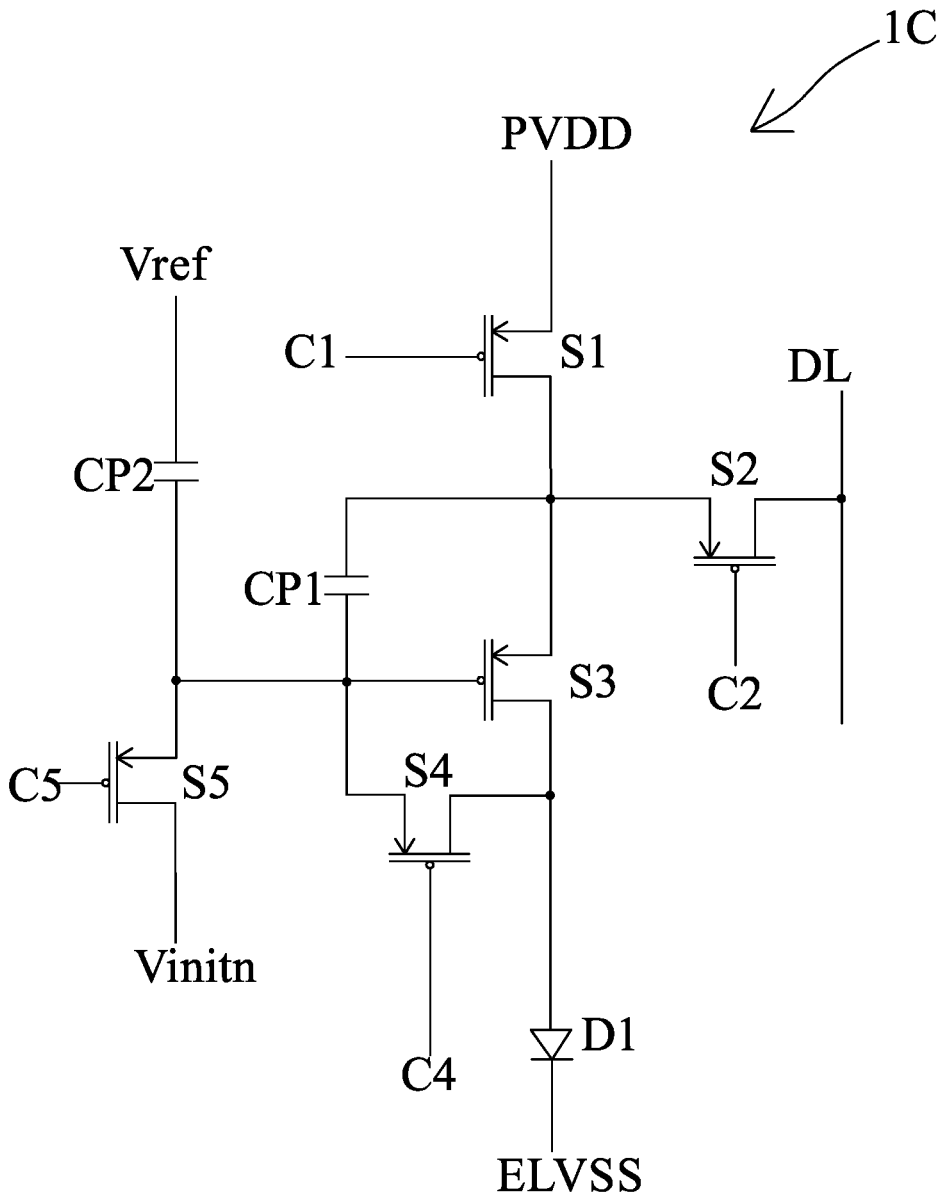
FIG. 10 shows a diagram schematically illustrating a pixel circuit of a display panel in accordance with a third embodiment of the present invention.

In another aspect of the invention, please refer to FIG. 10, which shows a diagram schematically illustrating a pixel circuit of a display panel in accordance with a third embodiment of the present invention. According to the third embodiment of the present invention, the disclosed pixel circuit 1C includes a first switch S1, a second switch S2, a third switch S3, a fourth switch S4, a fifth switch S5, a first capacitor CP1, a second capacitor CP2 and a diode D1. As can be seen in the figure of the third embodiment, the pixel circuit 1C, as compared to the previous pixel circuit 1A in the first embodiment in FIG. 1, further comprises a second capacitor CP2. Regarding the configuration of the second capacitor CP2, the second capacitor CP2 has a first end and a second end, the first end of the second capacitor CP2 is electrically connected with a reference voltage Vref, and the second end of the second capacitor CP2 is electrically connected to the second end of the first capacitor CP1, a gate of the third switch S3, a source of the fourth switch S4 and a source of the fifth switch S5. According to the third embodiment of the invention, the given reference voltage Vref is a preset voltage used to initialize the first capacitor CP1 and the second capacitor CP2. The operation flow of the disclosed pixel circuit 1C in the third embodiment are illustrated as in FIG. 11-FIG. 16.

Figure 11:
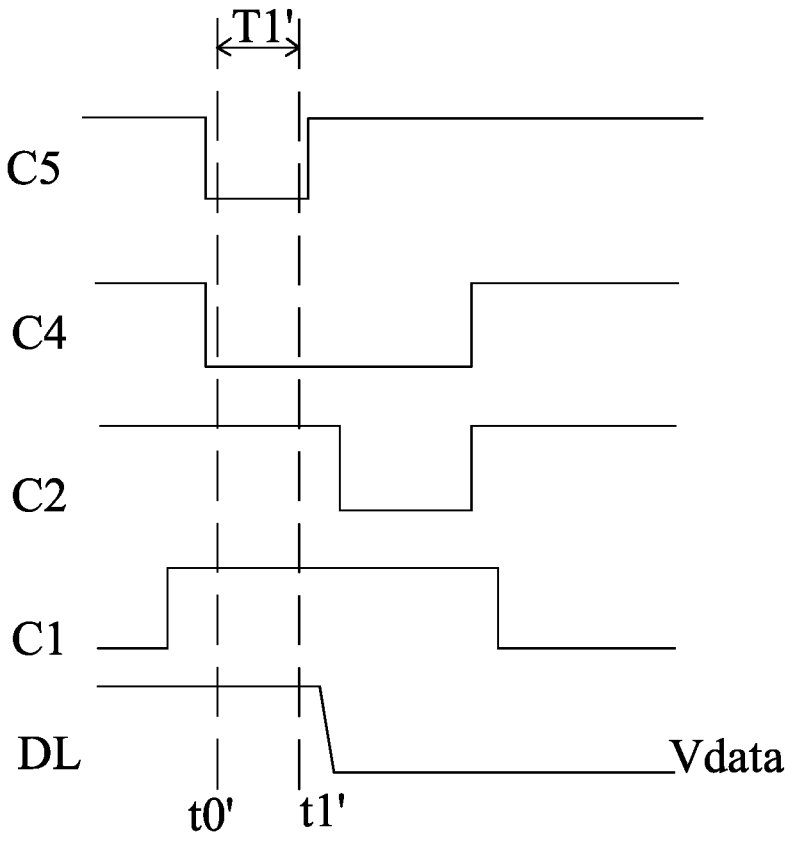
FIG. 11 schematically shows a plurality of waveform diagrams indicating the control signals in view of the voltage level of the data line in a first stage T1' relatively used to control the switches in accordance with the third embodiment of the invention.
Figure 12:
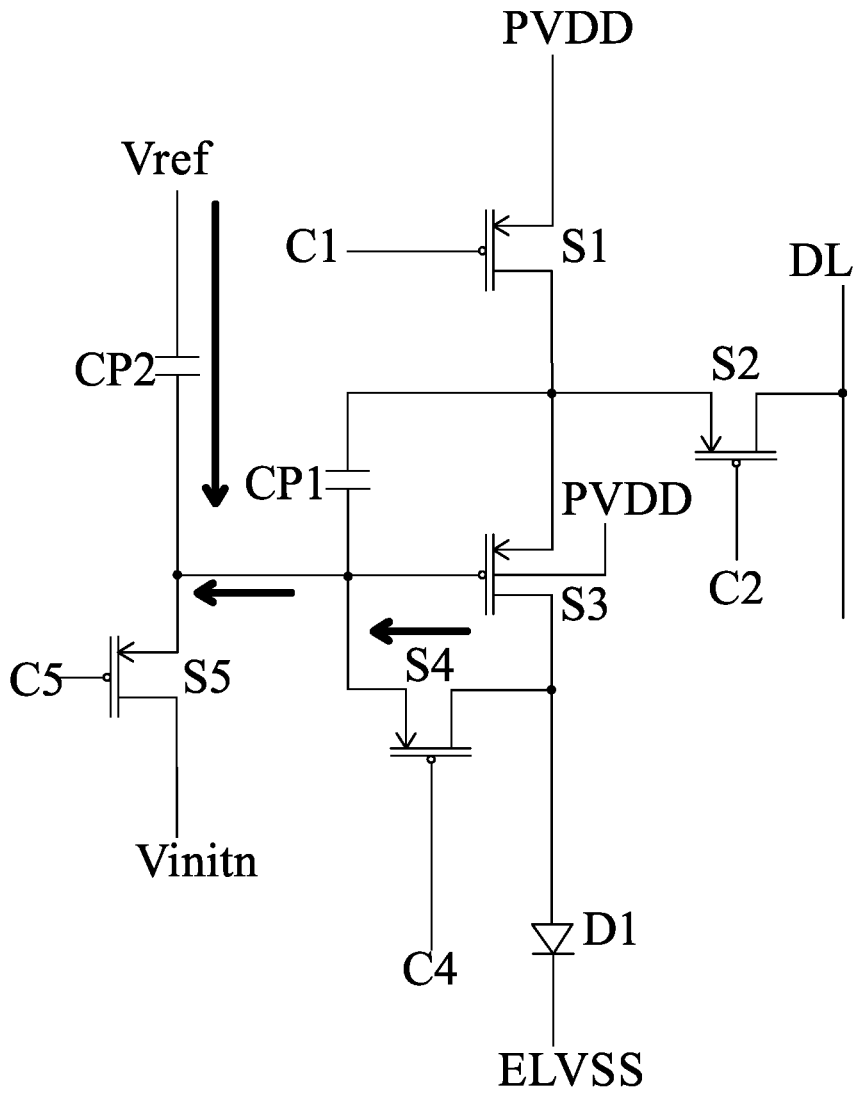
FIG. 12 schematically shows the current flow during the first stage T1' according to FIG. 11.

At first, please refer to FIG. 11, which schematically shows a plurality of waveform diagrams indicating the control signals in view of the voltage level of the data line relatively used to control the switches in accordance with the third embodiment of the invention. As can be seen in FIG. 11, the fifth control signal C5 is transmitted to the gate of the fifth switch S5 as its gate control signal for controlling an on and off state of the fifth switch S5. The fourth control signal C4 is transmitted to the gate of the fourth switch S4 as its gate control signal for controlling an on and off state of the fourth switch S4. The second control signal C2 is transmitted to the gate of the second switch S2 as its gate control signal for controlling an on and off state of the second switch S2. As can be seen in the third embodiment, the second control signal C2 used to control the second switch S2 is different from the fourth control signal C4 used to control the fourth switch S4. (In the first embodiment, the fourth control signal C4 is identical to the second control signal C2). The first control signal C1 is transmitted to the gate of the first switch S1 as its gate control signal for controlling an on and off state of the first switch S1. And, a voltage level of the data line DL is initially given at a high voltage level, and reduced to the data voltage Vdata afterwards.

For detailed operations, as can be seen in FIG. 11, when the pixel circuit 1C in FIG. 10 is operating in a first stage T1', indicating that t0'<t<t1', at this period of time, the fifth control signal C5 and the fourth control signal C4 are at a low voltage level while the second control signal C2 and the first control signal C1 are at a high voltage level. As a result, the fourth switch S4 and the fifth switch S5 will be turned on while the first switch S1 and the second switch S2 are turned off. The third switch S3 is at an on-state. Meanwhile, since (Vinitn<ELVSS-Vf_diode), wherein Vf_diode is the forward voltage of the diode D1, it is believed that the diode D1 is at an off-state as well. The current flow during the first stage T1' (t0'<t<t1') is therefore illustrated by arrows in FIG. 12. At this period of time, the second capacitor CP2 is thus initialized.

Figure 13:
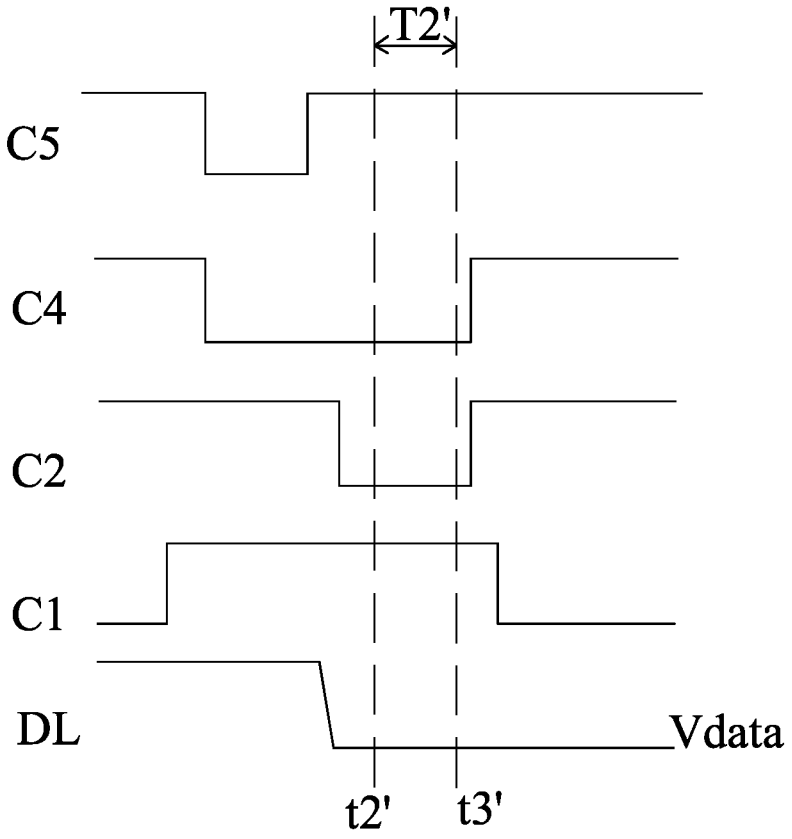
FIG. 13 schematically shows a plurality of waveform diagrams indicating the control signals in view of the voltage level of the data line in a second stage T2' relatively used to control the switches in accordance with the third embodiment of the invention.
Figure 14:
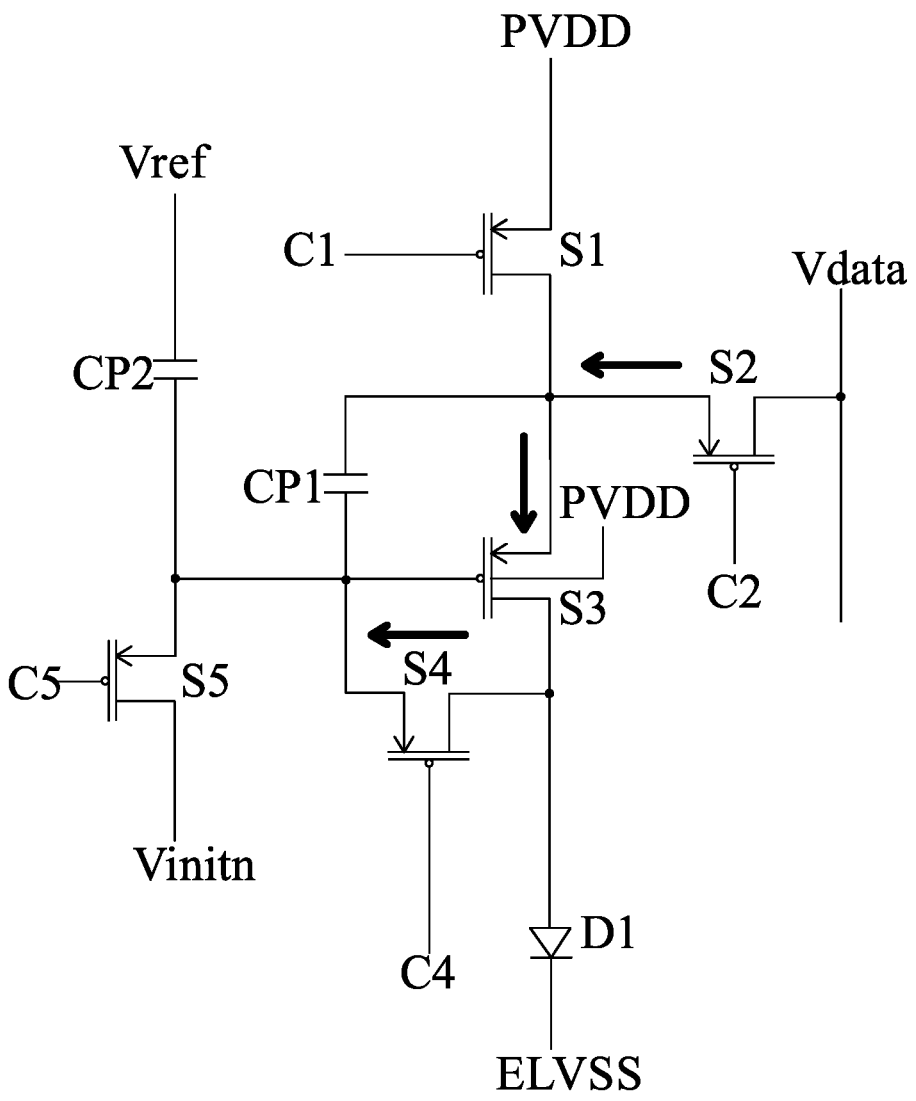
FIG. 14 schematically shows the current flow during the second stage T2' according to FIG. 13.

And then, please refer to FIG. 13 for a second stage T2', indicating that t2'<t<t3', at this period of time, the fifth control signal C5 and the first control signal C1 are at a high voltage level while the second control signal C2 and the fourth control signal C4 are at a low voltage level. As a result, the second switch S2, the fourth switch S4 will be turned on while the first switch S1 and the fifth switch S5 will be turned off. The third switch S3 is turned on. Meanwhile, since the voltage level of the data line DL is transitioned from the high voltage level and reduced to the data voltage Vdata at the second stage T2', and (Vdata−Vt_wr<ELVSS+Vf_diode), wherein Vt_wr is the compensation/write data state threshold voltage of the third switch S3, it is believed that the diode D1 is at an off-state as well. Therefore, the current flow during the second stage T2' (t2'<t<t3') is illustrated by arrows in FIG. 14. At this period of time, the first capacitor CP1 and the second capacitor CP2 are therefore, sampled and compensated for data to write in.

Figure 15:
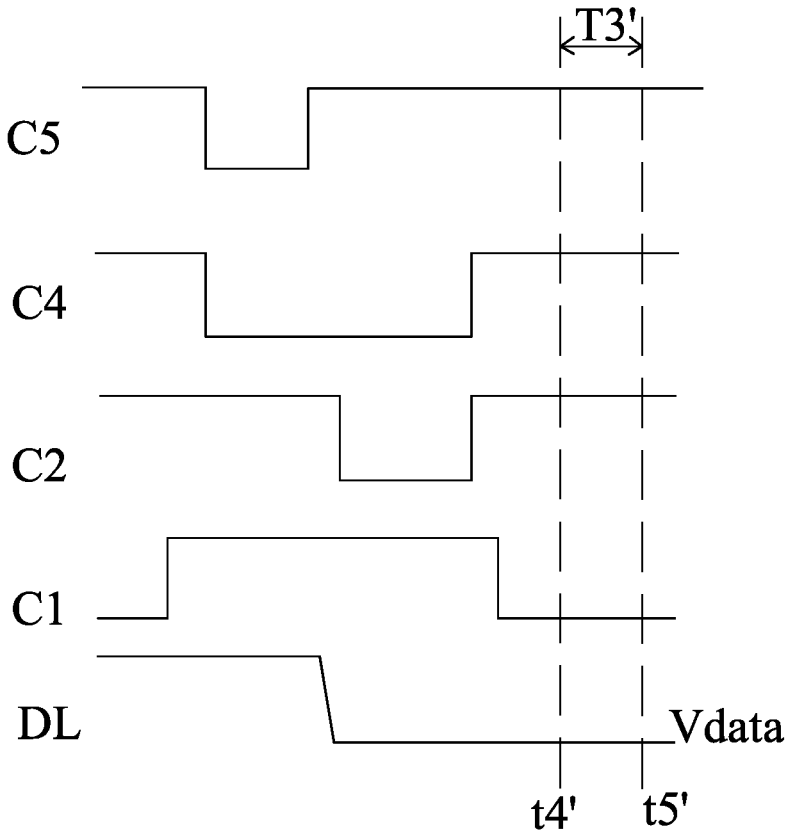
FIG. 15 schematically shows a plurality of waveform diagrams indicating the control signals in view of the voltage level of the data line in a third stage T3' relatively used to control the switches in accordance with the third embodiment of the invention.
Figure 16:
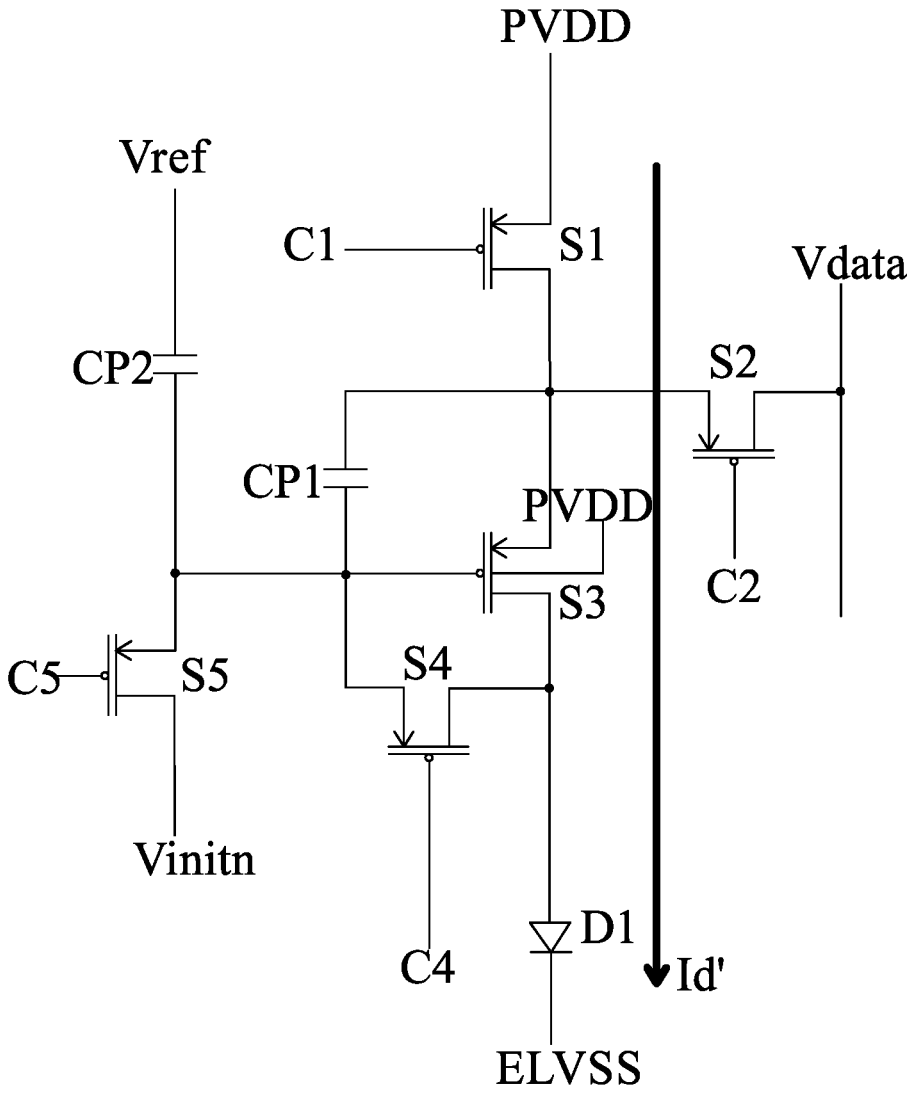
FIG. 16 schematically shows the current flow during the third stage T3' according to FIG. 15.

And finally, as can be seen in FIG. 15, when the pixel circuit 1C in FIG. 10 enters and is operating in a third stage T3', indicating that t4'<t<t5', at this period of time, the fifth control signal C5, the second control signal C2 and the fourth control signal C4 are at a high voltage level while the first control signal C1 is at a low voltage level. As a result, the second switch S2, the fourth switch S4 and the fifth switch S5 will be turned off while the first switch S1 is turned on. At this period of time during the third stage T3', the third switch S3 and the diode D1 are at an on-state as well. As a result, when the first switch S1, the third switch S3 and the diode D1 are turned on while the second switch S2, the fourth switch S4 and the fifth switch S5 are turned off, it is believed that a power rail composed of the first switch S1, the third switch S3 and the diode D1 is formed, and a power rail emission current is generated. The current flow during the third stage T3' (t4'<t<t5') is illustrated by arrows in FIG. 16. According to such a third embodiment, it is also derived that the power rail emission current Id' will be a function of (PVDD−Vdata). In other words, the final emission current Id' is only related to the positive supplied power voltage PVDD as well as the data voltage Vdata on the data line DL. Moreover, according to the third embodiment of the present invention when a second capacitor CP2 is further disposed in the pixel circuit 1C, it helps to increase the final emission current Id'. As compared the power rail emission current Id' in the third embodiment with the power rail emission current Id in the first embodiment in FIG. 7, the Applicant of the invention derives that an increased current can be obtained while the second capacitor CP2 is further disposed. And the increased current value is related to a ratio of capacitance of the second capacitor CP2 and the first capacitor CP1, indicated by: CP2/(CP1+CP2)).

Figure 17:
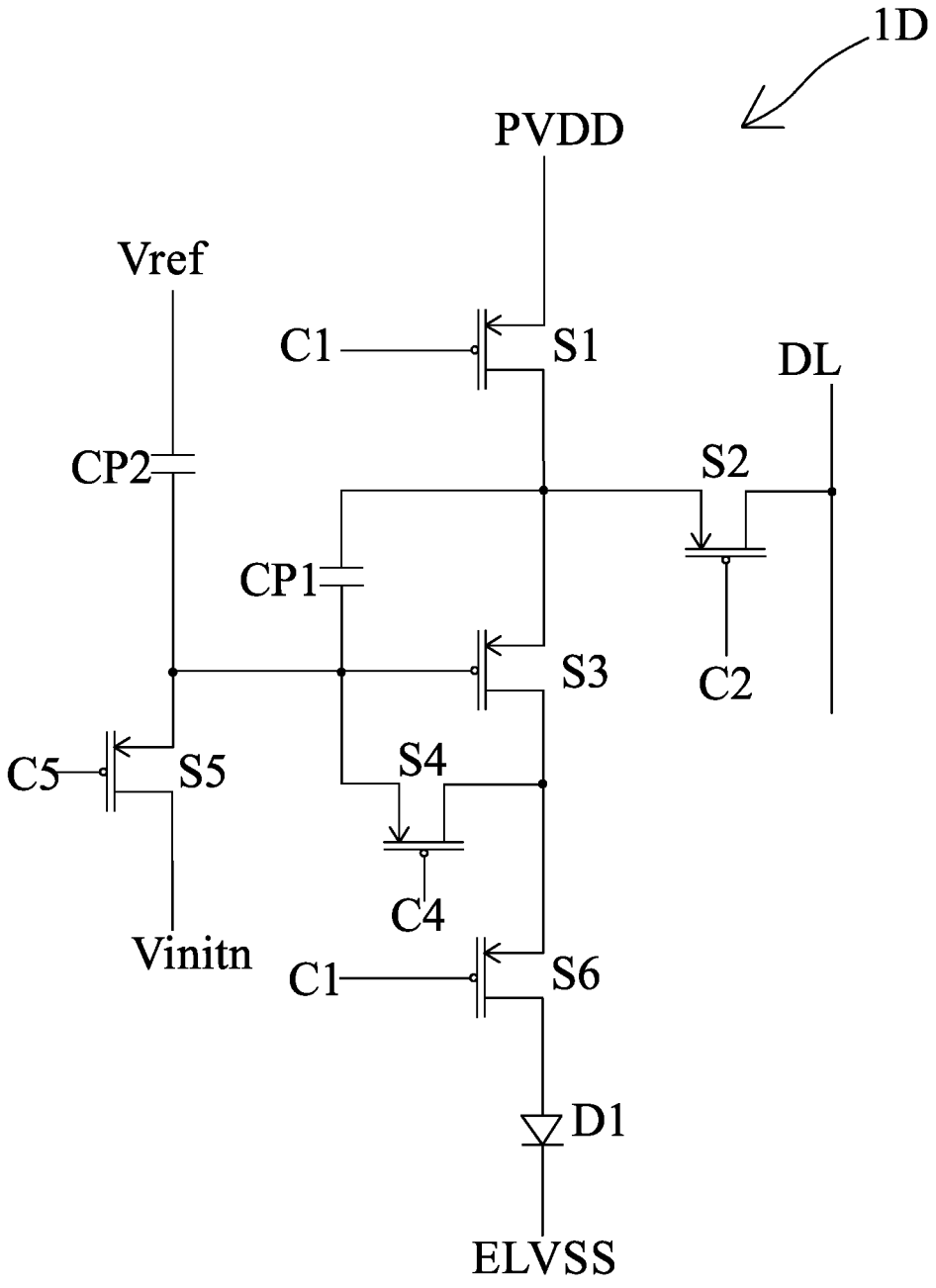
FIG. 17 shows a diagram schematically illustrating a pixel circuit of a display panel in accordance with a fourth embodiment of the present invention.
Figure 18:
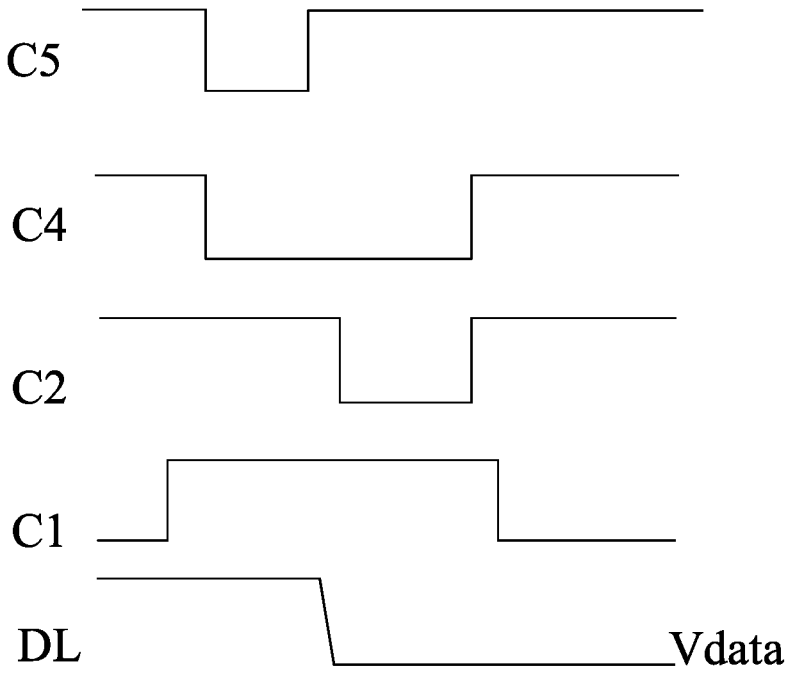
FIG. 18 schematically shows a plurality of waveform diagrams indicating the control signals in view of the voltage level of the data line relatively used to control the switches in accordance with the fourth embodiment of the invention.

In the following, please additionally proceed to refer to FIG. 17 for a further variant embodiment of the present invention. According to FIG. 17, it schematically shows a diagram illustrating a pixel circuit of a display panel in accordance with a fourth embodiment of the present invention. According to the fourth embodiment of the present invention, the disclosed pixel circuit 1D includes a first switch S1, a second switch S2, a third switch S3, a fourth switch S4, a fifth switch S5, a first capacitor CP1, a second capacitor CP2, a diode D1 and a sixth switch S6. As can be seen in the fourth embodiment, the pixel circuit 1D, as compared to the previous pixel circuit 1C in the third embodiment in FIG. 10, further comprises the sixth switch S6. As for the sixth switch S6, it is evident that the sixth switch S6 is being electrically connected between the third switch S3, the fourth switch S4 and the diode D1. According to the fourth embodiment of the present invention, the sixth switch S6 can be implemented by using a P-type Metal-Oxide-Semiconductor Field-Effect Transistor (P-MOSFET). It is apparent that a source of the sixth switch S6 is electrically connected with a drain of the third switch S3 and a drain of the fourth switch S4. A drain of the sixth switch S6 is electrically connected with the anode of the diode D1. In addition, a gate of the sixth switch S6 will be electrically connected with a gate of the first switch S1. In other words, the control signal transmitted to the gate of the sixth switch S6 for controlling the sixth switch S6, will be identical to the first control signal C1 for controlling the first switch S1. The plurality of waveform diagrams indicating the control signals in view of the voltage level of the data line relatively used to control the switches in accordance with the fourth embodiment of the invention are provided as shown in FIG. 18. According to the fourth embodiment, when an additional sixth switch S6 is disposed in the pixel circuit 1D and connected to the anode of the diode D1, it enhances to increase design flexibility of the voltage value of the given first initial voltage Vinitn, the second initial voltage Vinitp, and the data voltage Vdata. As a result, a much more flexible design voltage can be predetermined and performs also as an inventive effect of the fourth embodiment of the present invention.

Therefore, according to the present invention, the foregoing disclosed pixel circuit has been proposed to be effectively applied to a display panel. The present invention is thus achieving to successfully obtain an optimal emission current of a display panel, which is independent and not related to any initial voltages. Based on at least one embodiment provided above, the disclosed pixel circuit is able to be applied to a display panel which is composed of Micro Light-Emitting Diodes (μLEDs), Organic Light-Emitting Diode (OLEDs), or alternative silicon-based diodes. As a result, apparently the present invention is not limited by its application fields.

On account of the above, while compared to the prior arts, it is obvious that the present invention, when compared to the existing technologies, apparently shows much more effective performances than before. In addition, it is believed that the present invention is instinct, effective and highly competitive for IC technology and industries in the market nowadays, whereby having extraordinary availability and competitiveness for future industrial developments and being in condition for early allowance.

It will be apparent to those skilled in the art that various modifications and variations can be made to the present invention without departing from the scope or spirit of the invention. In view of the foregoing, it is intended that the present invention cover modifications and variations of this invention provided they fall within the scope of the invention and its equivalent.

What is claimed is:

1. A pixel circuit of a display panel, comprising:

a first switch, being electrically connected with a positive supplied power voltage (PVDD);

a second switch, being electrically connected with the first switch and a data line;

a third switch, being electrically connected with a common terminal of the first switch and the second switch, wherein the third switch generates an emission current as a driving transistor of the pixel circuit;

a first capacitor, having a first end and a second end, wherein the first end of the first capacitor is electrically connected with a common terminal of the first switch, the second switch and the third switch;

a fourth switch, being electrically connected with the second end of the first capacitor and the third switch;

a fifth switch, being electrically connected with a first initial voltage (Vinitn), wherein the second end of the first capacitor is further electrically connected with a common terminal of the third switch, the fourth switch and the fifth switch; and a diode, having an anode connected with a common terminal of the third switch and the fourth switch, and a cathode connected with a negative emission source voltage (ELVSS).

2. The pixel circuit of a display panel according to claim 1, wherein the first switch is a P-type MOSFET, a source of the first switch is electrically connected with the positive supplied power voltage (PVDD), a gate of the first switch is electrically connected with a first control signal, and a drain of the first switch is electrically connected with the first end of the first capacitor and a common terminal of the second switch and the third switch.

3. The pixel circuit of a display panel according to claim 1, wherein the second switch is a P-type MOSFET, a source of the second switch is electrically connected with a drain of the first switch and the first end of the first capacitor, a gate of the second switch is electrically connected with a second control signal, and a drain of the second switch is electrically connected with the data line.

4. The pixel circuit of a display panel according to claim 1, wherein the third switch is a P-type MOSFET, a source of the third switch is electrically connected with a drain of the first switch, a source of the second switch and the first end of the first capacitor, a gate of the third switch is electrically connected with the second end of the first capacitor and a common terminal of the fourth switch and the fifth switch, and a drain of the third switch is electrically connected with a common terminal of the fourth switch and the anode of the diode.

5. The pixel circuit of a display panel according to claim 1, wherein the fourth switch is a P-type MOSFET, a source of the fourth switch is electrically connected with the second end of the first capacitor, a gate of the third switch and a source of the fifth switch, a gate of the fourth switch is electrically connected with a fourth control signal, and a drain of the fourth switch is electrically connected with a drain of the third switch and the anode of the diode.

6. The pixel circuit of a display panel according to claim 1, wherein the fifth switch is a P-type MOSFET, a source of the fifth switch is electrically connected with the second end of the first capacitor, a gate of the third switch and a source of the fourth switch, a gate of the fifth switch is electrically connected with a fifth control signal, and a drain of the fifth switch is electrically connected with the first initial voltage (Vinitn).

7. The pixel circuit of a display panel according to claim 1, wherein when the first switch, the third switch and the diode are turned off while the second switch, the fourth switch and the fifth switch are turned on, the first capacitor is initialized; and wherein when the first switch, the fifth switch and the diode are turned off while the second switch, the third switch and the fourth switch are turned on, the first capacitor is sampled and compensated for data to write in; and wherein when the first switch, the third switch and the diode are turned on while the second switch, the fourth switch and the fifth switch are turned off, a power rail emission current is generated and only related to the positive supplied power voltage (PVDD) and a data voltage of the data line.

8. The pixel circuit of a display panel according to claim 1, wherein the diode is a Micro Light-Emitting Diode (μLED) or an Organic Light-Emitting Diode (OLED).

9. The pixel circuit of a display panel according to claim 1, further comprising a sixth switch being electrically connected between a drain of the third switch, a drain of the fourth switch and the anode of the diode.

10. The pixel circuit of a display panel according to claim 9, wherein the sixth switch is a P-type MOSFET, a source of the sixth switch is electrically connected with the drain of the third switch and the drain of the fourth switch, a gate of the sixth switch is electrically connected with a gate of the first switch, and a drain of the sixth switch is electrically connected with the anode of the diode.

11. The pixel circuit of a display panel according to claim 1, further comprising a second capacitor, wherein the second capacitor includes a first end and a second end, the first end of the second capacitor is electrically connected with a reference voltage, and the second end of the second capacitor is electrically connected to the second end of the first capacitor, a gate of the third switch, a source of the fourth switch and a source of the fifth switch.

12. The pixel circuit of a display panel according to claim 11, wherein when the first switch, the second switch and the diode are turned off while the third switch, the fourth switch and the fifth switch are turned on, the second capacitor is initialized; and wherein when the first switch, the fifth switch and the diode are turned off while the second switch, the third switch and the fourth switch are turned on, the first capacitor and the second capacitor are sampled and compensated for data to write in; and wherein when the first switch, the third switch and the diode are turned on while the second switch, the fourth switch and the fifth switch are turned off, a power rail emission current is generated and only related to the positive supplied power voltage (PVDD) and a data voltage of the data line.

13. The pixel circuit of a display panel according to claim 11, further comprising a sixth switch being electrically connected between a drain of the third switch, a drain of the fourth switch and the anode of the diode.

14. The pixel circuit of a display panel according to claim 13, wherein the sixth switch is a P-type MOSFET, a source of the sixth switch is electrically connected with the drain of the third switch and the drain of the fourth switch, a gate of the sixth switch is electrically connected with a gate of the first switch, and a drain of the sixth switch is electrically connected with the anode of the diode.

* * * * *